United States Patent [19]

Gunther, Jr. et al.

[11] 4,071,997

[45] Feb. 7, 1978

[54] MECHANISM AND METHOD OF MAKING AN ENVELOPE

[75] Inventors: William H. Gunther, Jr., Guilford; Roman M. Golicz, Clinton; James W. Hough, Madison, all of Conn.

[73] Assignee: Gunther Business Systems, Inc., Essex, Conn.

[21] Appl. No.: 680,788

[22] Filed: Apr. 27, 1976

[51] Int. Cl.[2] ..... B65B 11/48

[52] U.S. Cl. ..... 53/31; 53/32; 53/206; 53/209; 53/389; 93/63 R

[58] Field of Search ..... 53/31, 32, 206, 209, 53/266 A, 172, 389; 93/62, 63 R, 63 M; 229/69; 271/52.5; 156/512; 270/64; 83/106

[56] References Cited

U.S. PATENT DOCUMENTS

| | | | |
|---|---|---|---|
| 1,879,990 | 9/1932 | Oles | 93/62 X |
| 2,783,041 | 2/1957 | Merritt | 83/106 |
| 3,059,391 | 10/1962 | Volks et al. | 53/206 |
| 3,457,696 | 7/1969 | Berkley | 53/31 |
| 3,530,643 | 9/1970 | Levi | 53/209 X |
| 3,557,519 | 1/1971 | Lyon, Jr. | 53/31 |
| 3,626,821 | 12/1971 | Gendron | 93/63 M |
| 3,667,753 | 6/1972 | Norton | 271/64 |
| 3,673,763 | 7/1972 | Dorfmann | 53/209 X |
| 3,815,897 | 6/1974 | Hoehl et al. | 271/64 X |
| 3,908,333 | 9/1975 | Cavanna | 53/209 X |

*Primary Examiner*—Travis S. McGehee
*Assistant Examiner*—John Sipos
*Attorney, Agent, or Firm*—Holland, Armstrong, Wilkie & Previto

[57] ABSTRACT

An improved machine and method of making and folding a personalized letter and a personalized envelope.

41 Claims, 20 Drawing Figures

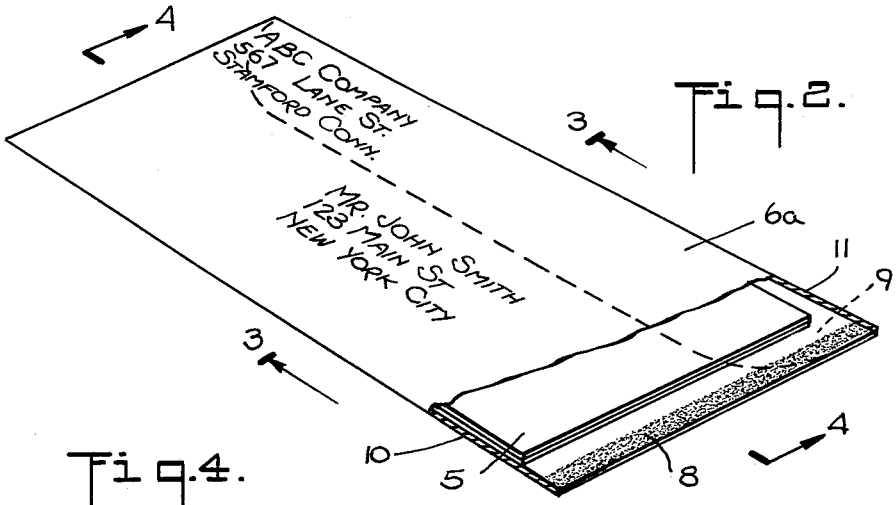
Fig. 2.
Fig. 4.
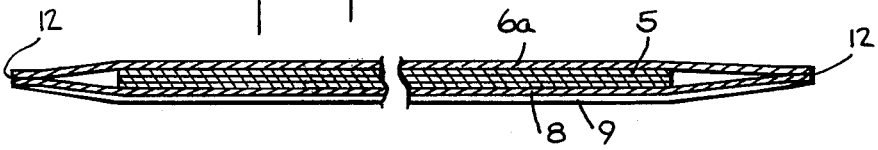
Fig. 3.
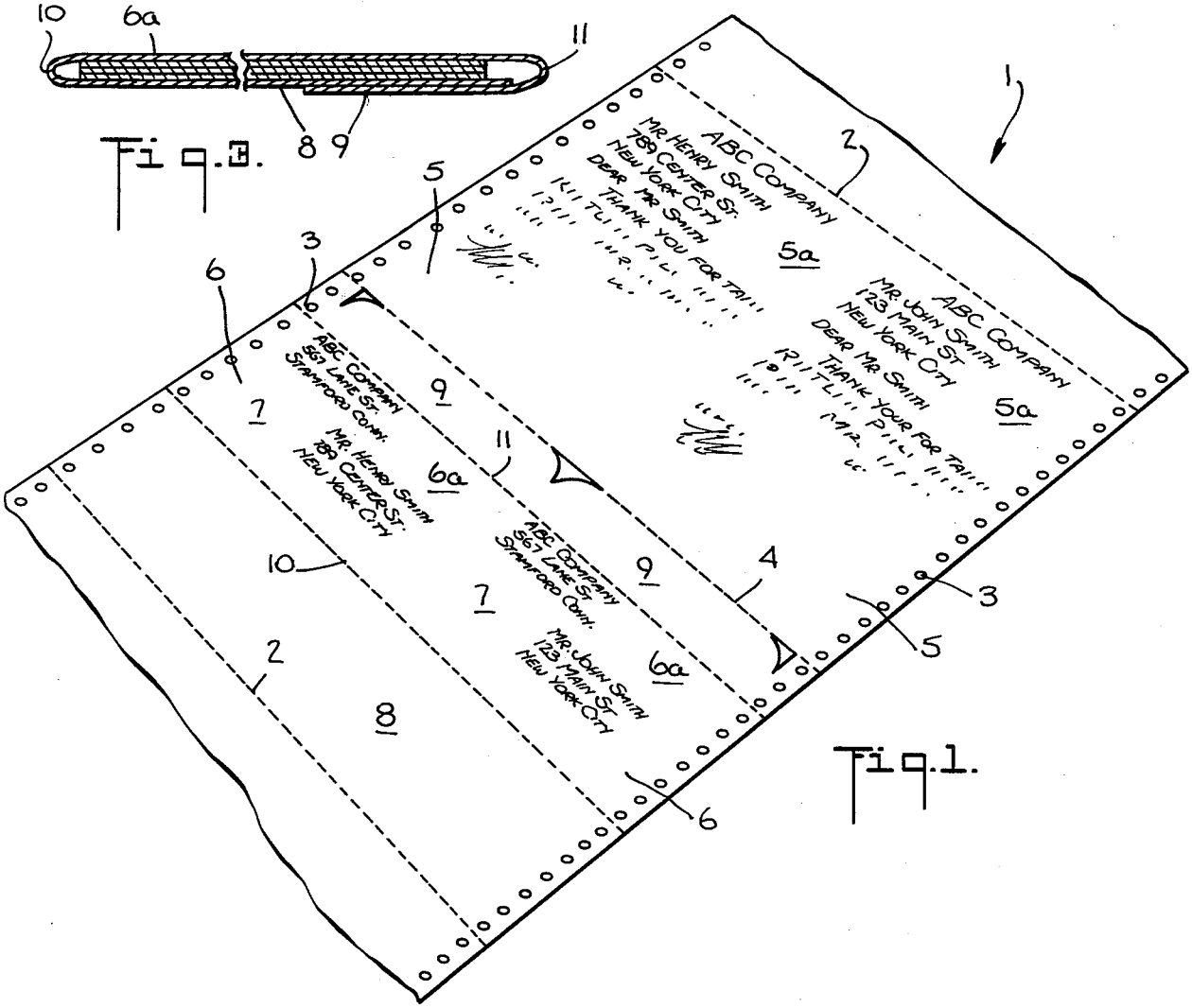
Fig. 1.

MECHANISM AND METHOD OF MAKING AN ENVELOPE

DESCRIPTION

The present invention is directed to an improved method and mechanism of making and folding an envelope and more particularly to a mechanism and method of making and folding a personalized envelope, and folding it around a personalized letter.

In various promotions, such as solicitations for subscribers, funds, etc. it is desirable for the envelope and the letter, or other message enclosed within the envelope, to be personalized.

Even if the personalized letter and envelope are both automatically printed by a computer, it is an expensive and a time consuming operation to stuff the personalized letter into the corresponding personalized envelope and to seal it. In addition, it is often desirable to add additional inserts to be sent with the letter.

Present machinery and methods do not provide for automatic printing of personalized letters and envelopes, for automatic wrapping of envelopes around the letters and for automatically adding additional inserts to the envelopes.

The present invention overcomes these difficulties and has for one of its objects the provision of an improved mechanism and machine which will automatically stuff a personalized letter into a personalized envelope, which will permit additional inserts to be automatically added to the envelope and which will automatically seal the contents within the envelopes.

Another object of the present invention is the provision of an improved method and machine which will apply adhesive to the envelopes at some time before the folding operation.

Other and further objects of the invention will be obvious upon an understanding of the illustrative embodiment about to be described, or will be indicated in the appended claims, and various advantages not referred to herein will occur to one skilled in the art upon employment of the invention in practice.

A preferred embodiment of the invention has been chosen for purposes of illustration and description and is shown in the accompanying drawings forming a part of the specification, wherein:

FIG. 1 is a perspective view of a continuous sheet or web having thereon a personalized printed envelope and a personalized letter which is to be positioned within the envelope.

FIG. 2 is a perspective view of the sealed personalized envelope with the personalized letter and other possible inserts therein.

FIG. 3 is a sectional view taken along line 3—3 of FIG. 2.

FIG. 4 is a sectional view taken along line 4—4 of FIG. 2.

FIG. 6 is a side elevational view of the portion of the machine shown in FIG. 5A.

Figures 5A, 7, 8:
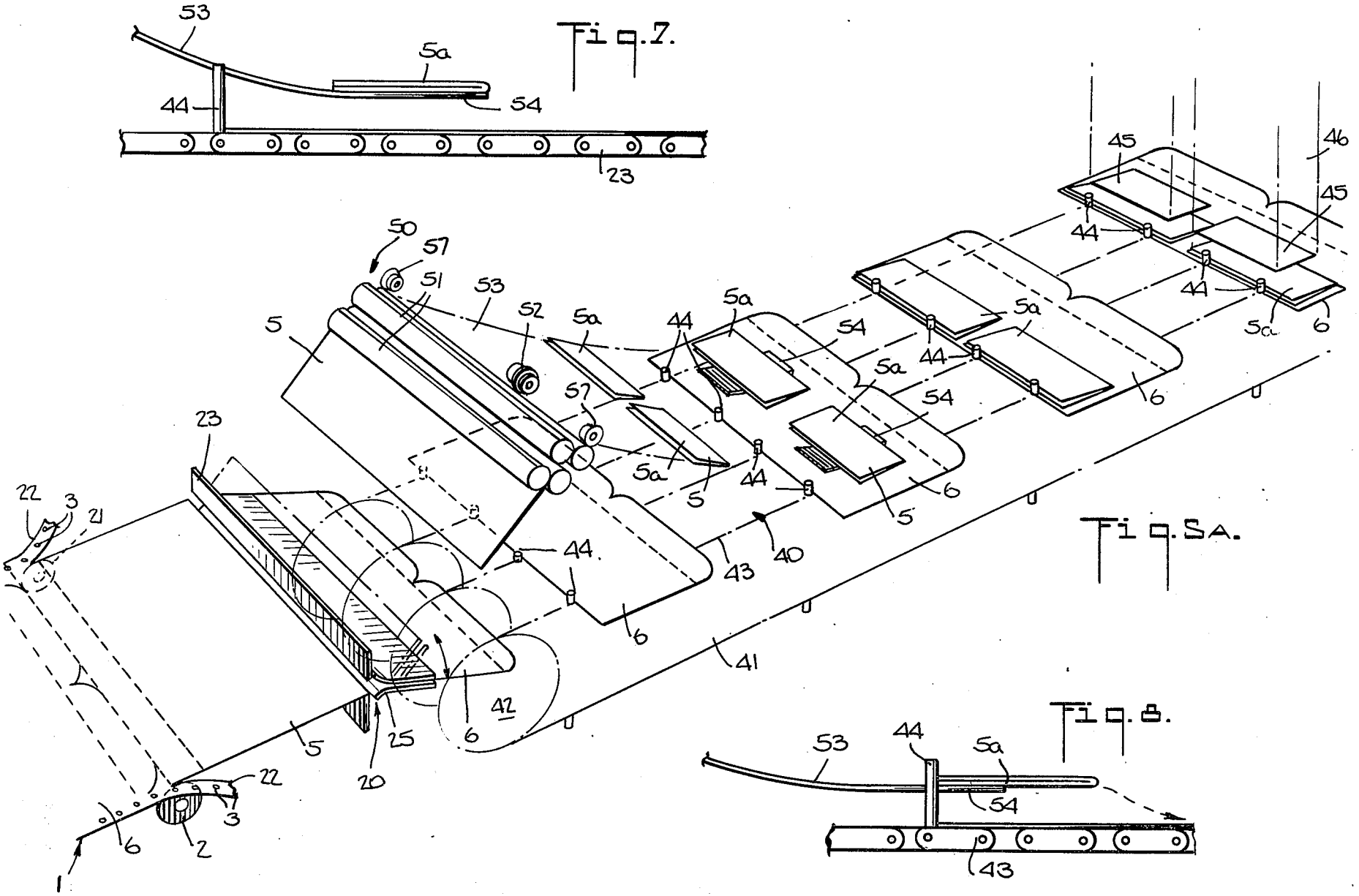
FIG. 5A shows the first portion of the improved machine used for performing the improved method of the present invention.
FIG. 7 is a detail showing the letter in position over an envelope.
FIG. 8 is a similar detail showing the letter being placed on the envelope.
Figure 5B:
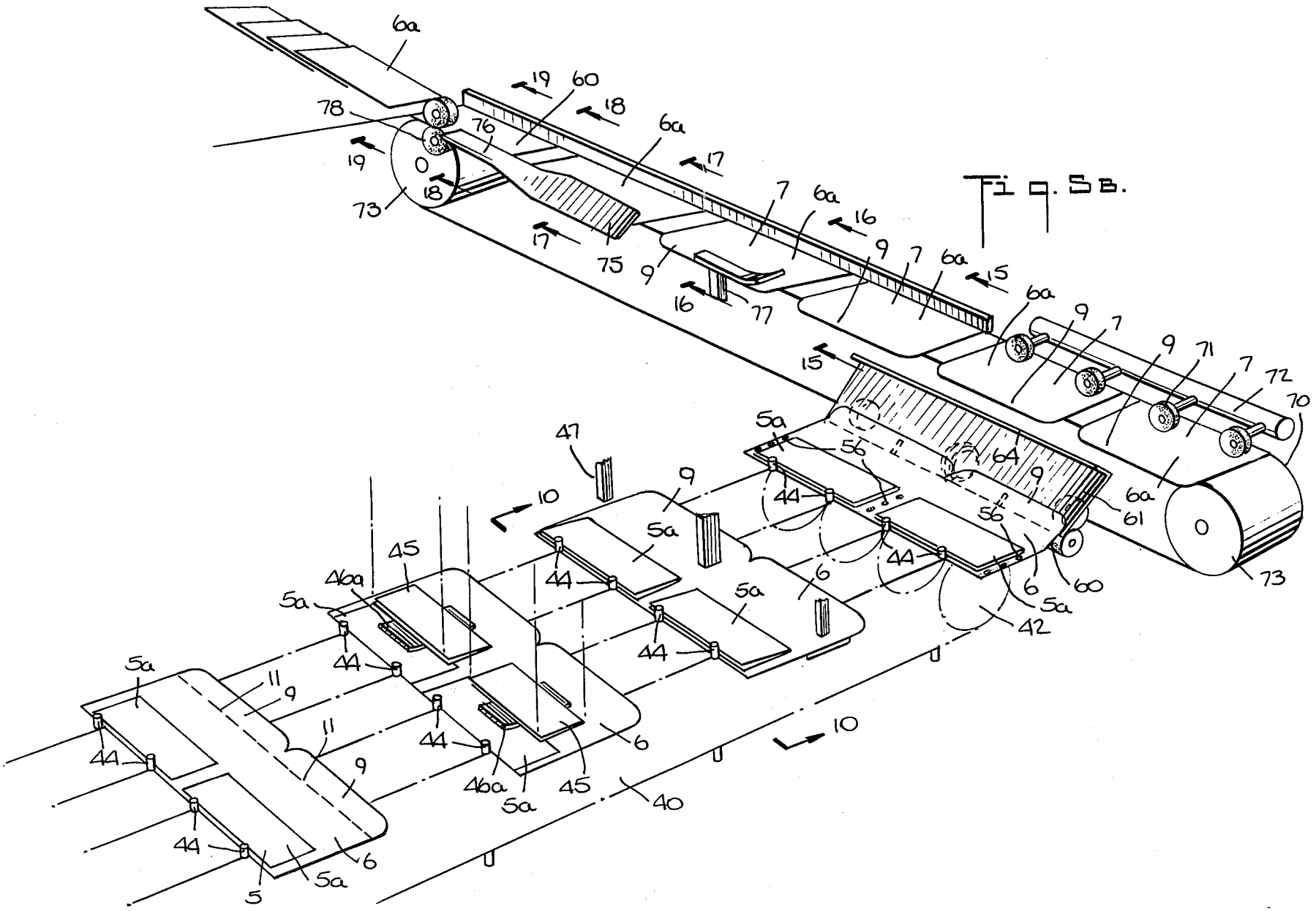
FIG. 5B shows the other portion of the same machine shown in FIG. 5A.
Figure 8:
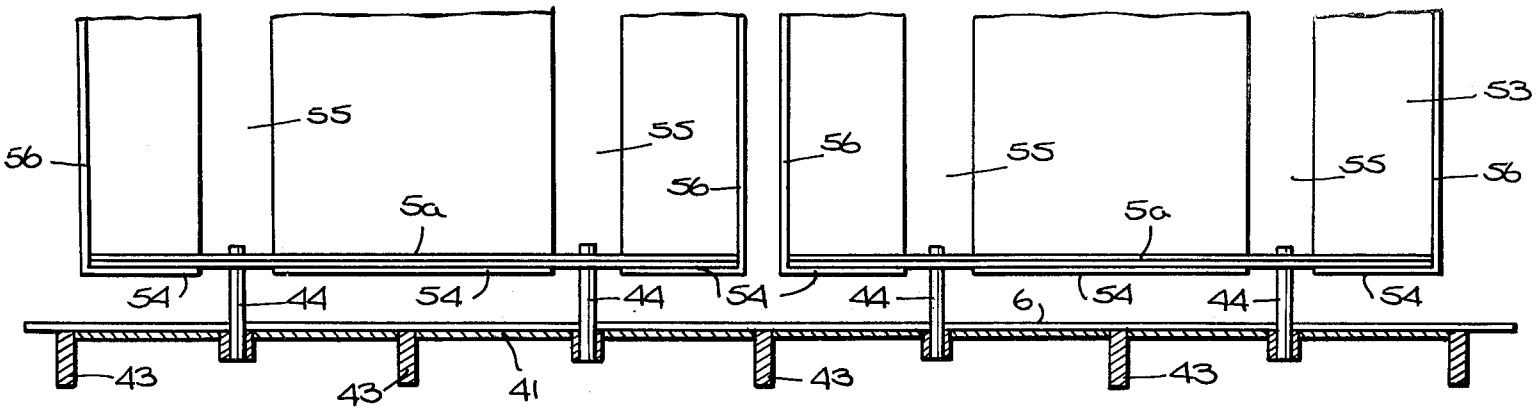
Figure 9:
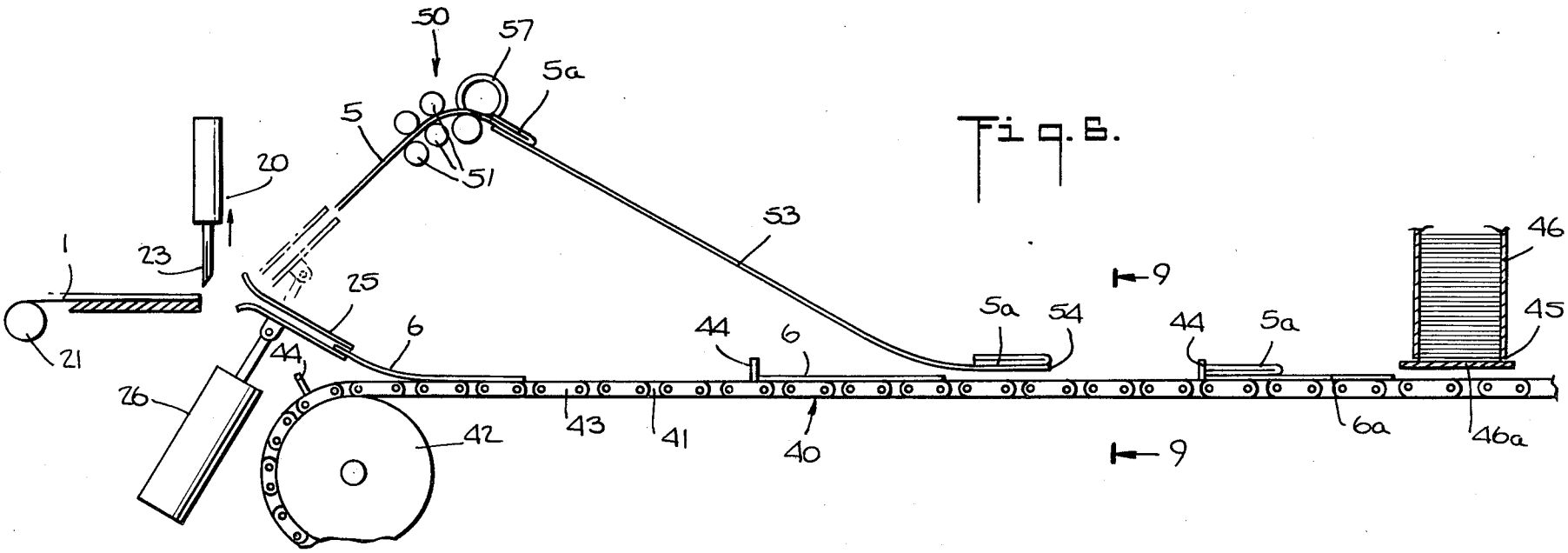
FIG. 9 is a sectional view taken along line 9—9 of FIG. 6.

Referring more particularly to the drawings, the web 1 from which the envelope and letter is made is shown in FIG. 1 and comprises a continuous composite sheet having a series of openings 3 along each edge to accommodate pins of a sprocket type feed mechanism (not shown). The web may be stored in a roll or in a fan fold, as may be desired.

The composite sheet is divided by transverse cut lines 2 and 4, which may be perforations, into a dual letter assembly 5, comprising a pair of transversely located letters 5*a*, and a dual envelope assembly 6, comprising a pair of transversely located envelopes 6*a*.

Each letter 5*a* has a message and a personalized address thereon. Each envelope 6*a* has a front panel 7 which as a personalized address, which corresponds to the personalized address on the letter 5*a* it is attached to, as well as a return address. Each envelope 6*a* has a rear panel 8 attached to front panel 7 by a fold line 10 and flap 9 attached by fold line 11 to the front panel 7. The fold lines 10 of each envelope 6*a* in each envelope assembly 6 are coextensive with each other and the fold lines 11 are also coextensive with each other.

In general, the method and mechanism of the present invention comprises separating the envelope assembly 6 from letter assembly 5, folding the letter assembly 5, and dividing the folded letter assembly 5 along the center to form two letters 5*a*. The folded letters 5*a* (as well as any other inserts 45) are placed on the rear panel 8 of the envelopes 6*a*. The front panel 7 is then folded over the letters 5*a* along fold 10 and the edges sealed and the flap 9 is folded over and adhered to the rear panel 8 to complete the envelope. The tractor holes 3 are preferably removed before any of the other steps are performed.

A web cutter assembly 20 is provided to separate the letter assembly 5 from the envelope assembly 6. The envelope assembly 6 is deflected downwardly and delivered to a moving first conveyor assembly 40. The letter assembly 5 is deflected upwardly to a folding, slitting and trimming mechanism 50 which folds the letter assembly 5, divides it into letters 5*a*, trims the letters to size and delivers the letters 5*a* onto the corresponding envelope 6*a* of envelope assembly 6 which is moving with the conveyor assembly 40. Thereafter, additional inserts 45 may be positioned on the envelope assembly 6.

The envelope assembly 6 then receives an adhesive to permit the end edges 12 to be sealed. At the appropriate time, the leading edges of the envelope assembly 6 is folded over the previously deposited letters 5*a* and inserts 45 by a folding assembly 60. Simultaneously, the end edge areas 12 which have previously received adhesive are pressed together to seal the end edges 12 thereof.

After discharge from the first conveyor assembly 40, the envelopes 6*a* are placed on a moving second conveyor assembly 70 where the flap 9 is folded over the rear panel and sealed thereto to complete the letter.

The continuous web 1 is preferably fed from a fan fold (not shown) storage area, however, it can also be fed from a roll, if desired. It is also within the purview of the present invention that the machine may operate with a previously separated letter assembly and envelope assembly.

The web 1 is first moved past a pair of side knife wheels 21 which remove edge strips 22 which have the feed holes 3 therein. The web 1 is then moved over cutting assembly 20 which comprises a knife edge 23 which separates the letter assembly 6 from the envelope assembly 5.

Immediately in back of the cutter assembly 20 is a pivotally mounted deflecting chute 25 which is adapted to be moved by a moving mechanism 26 from a lower position to deflect the envelope assembly 6 downwardly onto conveyor assembly 40 to a raised position to deflect the letter assembly 5 upwardly for insertion in a folding assembly 50. When the knife 23 cuts the web along cutting line 2 to separate the envelope assembly 6 from its corresponding letter assembly 5, the chute 25 is in its downward position so that the envelope assembly 6 is directed toward and deposited on a conveyor 41. The length of the envelope assembly as shown is long enough for the leading edge to be deposited on the conveyor when the knife cuts. In addition, suitable rollers may be provided to help move the envelope assembly onto the conveyor. When the knife 23 cuts the web along cutting line 4 to separate the letter assembly 5 from the next envelope assembly 6, the chute 25 is in its raised position (shown in broken lines) to direct the letters 5 upwardly to a folding assembly 50. As shown, the letters 5 are long enough for the leading edge to be gripped and pulled by the rolling mechanism when the knife cuts.

The conveyor assembly 40 comprises a continuously moving conveyor 41 driven by a wheel and chain assembly 42–43. The conveyor 41 has a plurality of transversely located upwardly extending longitudinally spaced drive pins 44. A pair of drive pins 44 are located on each side of the center line of the conveyor. When the envelopes are deposited onto the conveyor 41, the pins 44 strike the rear edge of the envelope assembly 6, to move it along with the conveyor 41. The pins 44 are adapted not only to strike and move the envelope assembly 6 but also to cause the letters 5 and the inserts 45, if any, to be deposited onto the envelopes 6*a* and to move the envelope assembly 6, letters 5*a* and other inserts 45 along.

The folding mechanism 50 which folds the letter assembly 5 before it is deposited onto the envelope assembly 6 is in the usual form, for example, similar to the one shown in U.S. Pat. No. 1,879,990, and comprises a series of rollers 51 which will fold the letter 5 in two or more folds depending on the particular type of folding desired. The folding mechanism 50 is a standard folding mechanism and, hence, will not be described in greater detail.

After the letter assembly 5 is folded, it is moved past a rotary knife 52 which divides the letter assembly 5 longitudinally into two separate letters 5*a* and past trimming rotary knives 57 which removes excess material to trim the letters to size. The letters 5*a* are deposited on an inclined chute 53 which overlies the conveyor 41, and which terminates in a toe 54. The two letters 5*a* slide down the chute 53 until they rest on the toe 54. Rollers similar to rollers on knives 57 may be used to push the letters downwardly. The toe 54 is positioned in close adjacency over the conveyor 41 and is substantially parallel to the conveyor 41. The chute 53 has longitudinal slits 55 therein to permit the pins 44 to move therethrough. Guide rails 56 are provided to prevent the sliding letters 5*a* from angling when sliding down chute 53.

With the letters 5*a* resting on toes 54, the pins 44 which are moving the envelope assembly 6 forward, move through the slits 55 and strike the rear edge of the folded letters 5*a* so as to move them off toe 54 and deposit them on their corresponding personalized envelopes 6*a* of the envelope assembly 6. Since the letters 5*a* are moving at about the same speed as the envelope assembly 6, the chute 53 allows letters to move down to toes 54 at least as quickly as it takes the envelopes to be positioned below toes 54 so that each personalized letter 5*a* will be deposited on its respective personalized envelope 6*a*.

The envelope assembly 6 with letters 5*a* thereon is then moved by pins 44 beneath an insert depositing assembly 46 which holds inserts 45. The insert depositing assembly 46 is preferably of the suction type, however, in the drawing, the assembly 46 is shown as comprising a chute 46 which holds the lowermost insert 45 suspended over the moving conveyor 41 on a shoe 46*a*. The shoe 46*a* is positioned over the conveyor 41 a distance less than the height of the pins 44. Hence the moving pins 44 strike the insert 45 and push it on the letters 5*a*.

Figures 10, 11, 12, 13:
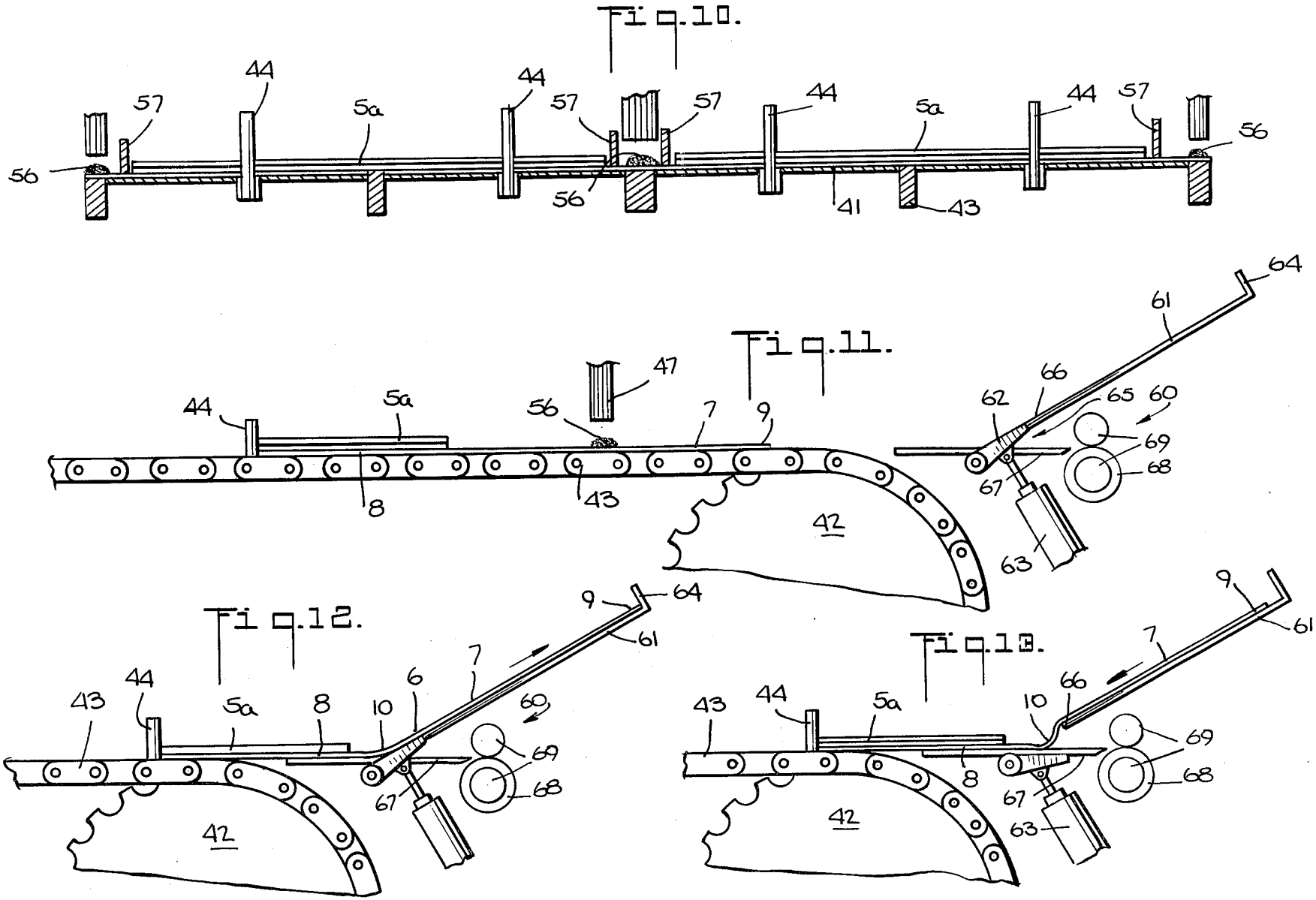
FIG. 10 is a sectional view taken along line 10—10 of FIG. 5B.
FIG. 11 is a side view of an adhesive applicator for applying adhesive to the envelope.
FIG. 12 is a detail of the first step in the envelope folding mechanism.
FIG. 13 is a detail showing the second step in the envelope folding mechanism.
Figure 14:
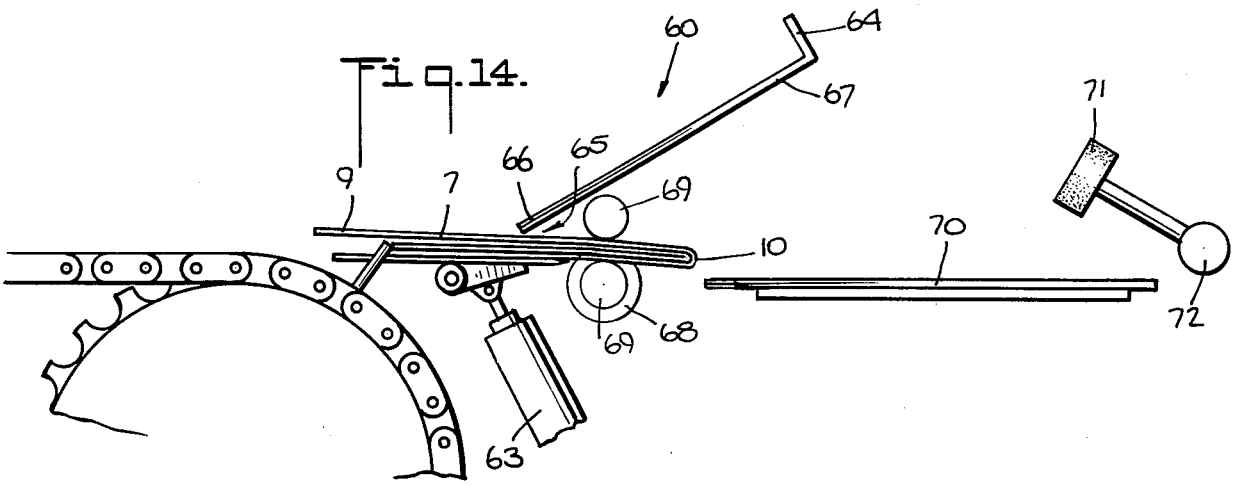
FIG. 14 is a detail showing the third step in the envelope folding mechanism.
Figure 15:
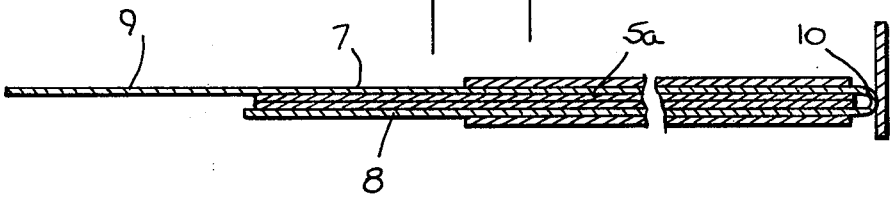
FIG. 15 is a sectional view taken along line 15—15 of FIG. 5B.
Figure 16:
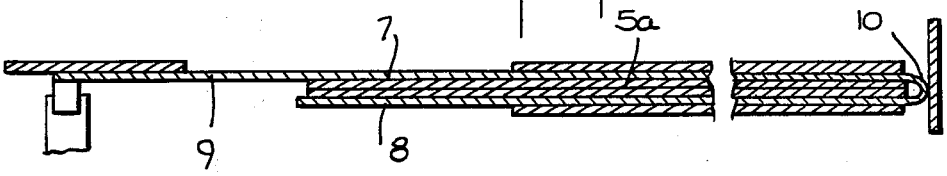
FIG. 16 is a sectional view taken along line 16—16 of FIG. 5B.
Figure 17:
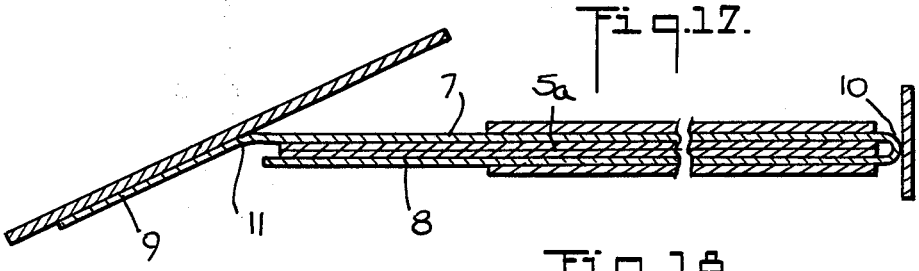
FIG. 17 is a sectional view taken along line 17—17 of FIG. 5B.
Figure 18:
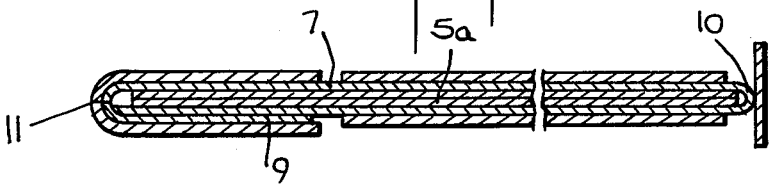
FIG. 18 is a sectional view taken along line 18—18 of FIG. 5B.
Figure 19:
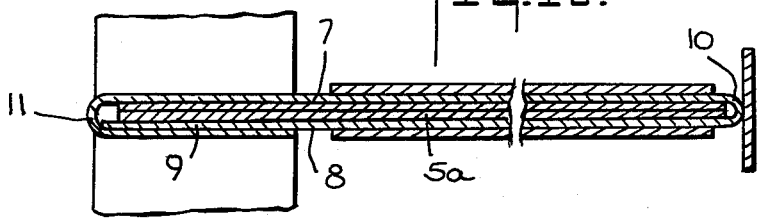
FIG. 19 is a sectional view taken along line 19—19 of FIG. 5B.

The combination is then moved by pins 44 beneath an adhesive applicator assembly 47 which applies adhesive to center and end strips of the envelope assembly 6 which will become edges 12 when the envelopes 6*a* are severed. The adhesive applicator 47 may be any conventional type of applicator, such as a sprayer, a roller or a spotter. In the preferred form of the invention, the adhesive 56 is a hot melt wax which is applied in spots by center nozzle 48 and end nozzles 49 along the center and side strips of envelope assembly 6. Guide rails 57 which guide spaced letters 5*a* FIG. 10) prevent adhesive 56 from being applied to the letters 5*a*. However a pre-gummed envelope may also be used if desired.

The combination is then moved to an envelope wrapping assembly 60 which comprises an upwardly inclined ramp 61 and diverting device 62 adapted to divert the leading edge of the envelope assembly 6 unto the ramp 61. The diverting fingers 62 are shown as being lowered by a hydraulic cylinder 63. However any other means, such as a cam, can control the fingers 62.

As the pins 44 move the envelope assembly 6, together and with letters 5*a* and inserts 45 along, the diverting device 62 is in its raised position so that the leading edge of the envelope assembly 6 embodying flap 9 moves up the ramp 61 until it strikes a stop 64. At that point, the device 62 is lowered to open a gap 65 between lower edge 66 of ramp 61 and feed plate 67. As the pins 44 continue to move the combination forward the envelope assembly 6 buckles along fold along 10 and the envelope assembly 6 is pushed through the gap 65.

Rollers 69 move faster than conveyor 40 so that as soon as the envelope starts moving through gap 65 the rollers 69 pull it through the gap and onto conveyor 70.

As the folded envelope assembly 6 and its contents letters 5a and inserts 45 are moved by rollers 69, a rotary cutting wheel 68 severs the envelope assembly 6 into two envelopes 6a. The rollers 69 also cause the two panels 8 and 7 of each envelope 6a to adhere to each other along edges 12 where the adhesive 56 has been previously applied.

The folded and edge sealed envelopes 6a are then moved onto second conveyor 70 which is moved by drive 73 which is at an angle (preferably at a right angle) to the first conveyor 41. Rollers 71 are mounted on pivotally movable shaft 72 to apply pressure to the envelopes 6a to force them to be moved by conveyor 70. Shaft 72 rocks upwardly to raise the rollers 71 to permit envelopes 6a to be deposited on conveyor 70 and then rocks downwardly to lower rollers 71 to apply pressure to envelopes 6a. The rocking of shaft 72 is timed to the movement of the plate 67.

The second coneyor 70 moves the envelopes past a flap folding shoe 75 which is especially contoured (as shown in FIGS. 15 to 18), to fold the flap 9 as each envelope moves past it. An adhesive is applied to flap 9 by applicator 77 as the envelope 6a moves past it. The shoe 75 has a bend 76 which terminates in a U-shaped configuration to fold the flap 9. The envelopes are then moved past pressure rollers 78 which seals flap 9 and and are then moved off the conveyor 71.

The machine described above was described in connection with a web having a pair of letters 5a and envelopes 6a in side-by-side relationship to each other. It will be understood that the mechanism may be used with a web having a single letter and envelope in which case there is no need to centrally sever the web.

It is also possible for the envelope blank to have an adhesive applied to it at an earlier stage which can then be activated either by moisture or by pressure or any other appropriate means to form the proper sealing of the envelope.

It is also possible to move the envelope on a separate web from the letter. The machine can take that envelope and match it with the appropriate letter at a point in the machine whereupon the envelope would be folded around the cut and folded letter and the other contents to be inserted within the envelope.

After the sealing of the flap of the envelope, the individual letters can be sorted into various categories, such as by weight for different amounts of postage or zip code sorting.

In addition, information gathered from the original letter as it is passed through the machine can be read to add inserts selectively at the insert stations.

In addition, it is possible for the invention to operate with inserts only and without a letter.

It is also possible for the blanks to have a window therein for addresses to show through.

Hence, the present invention provides a machine and method which will automatically stuff a personalized letter into a personalized envelope, which permits additional inserts to be added to the envelope and which automatically seals the contents.

Furthermore the present invention permits the envelope blank to have an adhesive applied to it automatically before the folding operation.

As many and varied modifications of the subject matter of this invention will become apparent to those skilled in the art from the detailed description given hereinabove, it will be understood that the present invention is limited only as provided in the claims appended hereto.

What is claimed is:

1. A mechanism for forming an envelope, comprising a composite sheet which includes an envelope assembly and a letter insert assembly connected together in lengthwise relationship to each other, means for moving said composite sheet in a lengthwise direction, means for severing said composite sheet widthwise between said letter insert assembly and said envelope assembly to separate the two assemblies, means for moving the envelope assembly along one path and for moving the letter insert assembly along another path, said means for moving the letter insert assembly includes means for positioning the letter insert assembly in superimposed relationship to the envelope assembly, said means for moving the envelope assemblies includes means for causing the letter insert assembly to be deposited on said moving envelope assembly, means for folding the envelope assembly around the letter insert assembly and means for sealing the edges of the envelope assembly.

2. A mechanism as claimed in claim 1 wherein the paths of said insert assembly and said envelope assembly are in superimposed relationship to each other.

3. A mechanism as claimed in claim 2 wherein means are provided for alternately deflecting said insert assembly and said envelope assembly for deposition of each of the respective moving means.

4. A mechanism as claimed in claim 3, wherein said deflecting means comprises a pivotally mounted deflecting chute.

5. A mechanism as claimed in claim 4 wherein said envelope assembly moving means comprises conveyor means having upstanding pins adapted to strike the envelope assembly.

6. A mechanism as claimed in claim 5 wherein said letter insert assembly moving means comprises a slide chute overlying the conveyor means down which the letter insert assembly slides, said slide chute having a lower toe overlying the conveyor means.

7. A mechanism as claimed in claim 6 wherein slits are provided in said slide chute to permit the pins to strike the letter insert assembly and push it off the toe and onto an envelope assembly.

8. A mechanism as claimed in claim 7 wherein said deflecting means comprises a chute movable from one position to direct an envelope assembly to the conveyor means to a second position to direct the letter insert assembly to the slide chute.

9. A mechanism as claimed in claim 8 wherein a folding mechanism is provided adjacent the upper edge of said slide chute to fold the letter insert assembly.

10. A mechanism as claimed in claim 9 wherein means are provided for applying adhesive to the edges of the envelope assembly.

11. A mechanism as claimed in claim 10 wherein said envelope assembly folding means comprises a ramp having a stop at its forward end and being spaced above the plane of the conveyor to form a gap and means for causing the envelope to fold along a fold line and to push the folding envelope through said gap.

12. A mechanism as claimed in claim 11 wherein a deflecting mechanism is provided movable upwardly to close the gap and permit the envelope to move up the ramp and to thereafter be movable downwardly to open the gap to permit the envelope to pass through the gap.

13. A mechanism as claimed in claim 12 wherein pressure applying means are provided to seal the edges of the folded envelope assembly.

14. A mechanism as claimed in claim 13 wherein means are provided for transferring said folded envelope assembly to a flap folding means.

15. A mechanism as claimed in claim 14 wherein said flap folding means comprises second conveyor means moving at an angle to said first conveyor means.

16. A mechanism as claimed in claim 15 wherein pressure rollers are adapted to place the envelopes into contact with the second conveyor means.

17. A mechanism as claimed in claim 16 wherein said pressure means comprises a roller assembly pivotally mounted above said second conveyor means, movable from a raised position to allow an envelope assembly to be deposited on the second conveyor means to a lowered position in contact with the envelope assembly.

18. A mechanism as claimed in claim 17 wherein an adhesive is applied to the flap, means are provided to turn the flap, and a pressure roller is provided to seal the flap.

19. A mechanism as claimed in claim 18 wherein said envelope assembly and said letter insert assembly are on a continuous web and wherein cutter means are provided in advance to said deflecting means to separate the letter insert assembly from the envelope assembly and to cause the deflecting means to alternately deposite the envelope assembly onto the first conveyor means and the insert assembly to the slide chute.

20. A mechanism as claimed in claim 19 wherein said web has perforations along the edges and wherein means are provided for removing the perforations before the web is moved to the cutter means.

21. A mechanism as claimed in claim 20 wherein a pair of letter insert assemblies and a pair of envelope assemblies are provided transversely of each other on the web on either side of the center line of the web.

22. A mechanism as claimed in claim 21 wherein a cutter is provided near the top of said chute to cut the letter insert assembly along the center.

23. A mechanism as claimed in claim 22 wherein guides are provided on the chute to prevent the letter insert assembly from angling.

24. A mechanism as claimed in claim 23 wherein said adhesive applier applies adhesive to the edges of the envelope assembly and along the center line.

25. A mechanism as claimed in claim 24 wherein guide rails are provided on each side of the letter insert assembly when positioned on the envelope assembly to prevent adhesive from being applied to the letter.

26. A mechanism as claimed in claim 25 wherein a cutter is provided after the folding mechanism to cut the envelope along the center line to form two envelopes.

27. A mechanism as claimed in claim 26 wherein means are provided to deposit additional inserts on said envelope assembly, in advance of the envelope folding mechanism, said means comprising a mechanism to position addition inserts over the first conveyor means to permit the pins to strike the inserts and cause them to drop on the envelope assembly.

28. A mechanism as claimed in claim 27 wherein side trimming knives are provided adjacent the letter folding means to trim the edges.

29. A method for forming an envelope from a composite sheet which includes an envelope assembly and a letter insert assembly connected together in lengthwise relationship to each other comprising moving said composite sheet in a lengthwise direction, severing said composite sheet widthwise between said letter assembly and said envelope assembly to separate the two assemblies, moving the envelope assembly along one path and moving the letter assembly along another path, positioning the insert assembly in superimposed relationship to the envelope assembly, causing the insert assembly to be deposited on said moving envelope assembly, folding the envelope assembly around the insert assembly and sealing the edges of the envelope assembly.

30. A method as claimed in claim 29 wherein the paths of said insert assembly and said envelope assembly are in superimposed relationship to each other.

31. A method as claimed in claim 30 wherein said insert assembly and said envelope assembly are alternately deflected for deposition of each on the respective moving means.

32. A method as claimed in claim 31 wherein said insert assembly is folded before deposition on the envelope assembly.

33. A method as claimed in claim 32 wherein adhesive is applied to the edges of the envelope assembly and pressure is applied to the edges of the folded envelope assembly to seal them.

34. A method as claimed in claim 33 wherein the flaps of said folded envelope assembly are folded and adhered and wherein said envelope is moved in a second direction while the flap is folded.

35. A method as claimed in claim 34 wherein said envelope assembly and said letter insert assembly are on a continuous web and wherein the web is cut in advance to said deflecting step to separate the letter insert assembly from the envelope assembly.

36. A method as claimed in claim 35 wherein said web has perforations along the edges and the perforations are removed before the web is cut.

37. A method as claimed in claim 36 wherein a pair of letter insert assemblies and a pair of envelope assemblies are provided transversely of each other on the web on either side of the center line of the web and said letter insert assembly is cut along the center before being folded.

38. A method as claimed in claim 37 wherein adhesive is applied to the edges of the envelope assembly and along the center line.

39. A method as claimed in claim 38 wherein after the folding the envelope is cut along the center line to form two envelopes.

40. A method as claimed in claim 39 wherein said letter insert assembly is folded before deposition on the envelope assembly.

41. A method as claimed in claim 40 wherein additional inserts are deposited on the envelope assembly before folding.

* * * * *